United States Patent [19]

Yamaguchi

[11] 4,101,034

[45] Jul. 18, 1978

[54] PACKING BOX

[75] Inventor: Akio Yamaguchi, Kawagoe, Japan

[73] Assignee: Honda Giken Kogyo Kabushiki Kaisha, Tokyo, Japan

[21] Appl. No.: 830,823

[22] Filed: Sep. 6, 1977

[30] Foreign Application Priority Data

Sep. 13, 1976 [JP] Japan ..... 51-123096[U]

[51] Int. Cl.[2] ..... B65D 5/54; B65D 17/24

[52] U.S. Cl. ..... 206/612; 229/15; 229/27

[58] Field of Search ..... 229/15, 27; 206/612, 206/616, 615, 630

[56] References Cited

U.S. PATENT DOCUMENTS

| | | | |
|---|---|---|---|
| 3,007,623 | 11/1961 | Clemens | 229/27 |
| 3,224,633 | 12/1965 | Allen | 206/612 |
| 3,327,923 | 6/1967 | Baughan | 206/612 |
| 3,394,869 | 7/1968 | Fontana et al. | 229/15 X |
| 3,403,836 | 10/1968 | Farguhar | 229/15 X |
| 3,533,874 | 10/1970 | Elias | 229/15 UX |
| 3,539,093 | 11/1970 | Massengill | 206/612 X |
| 3,677,458 | 7/1972 | Gosling | 229/27 |
| 3,853,259 | 12/1974 | Tupper | 229/15 |

*Primary Examiner*—Davis T. Moorhead

*Attorney, Agent, or Firm*—Irving M. Weiner

[57] ABSTRACT

A packing box which is sectioned in its interior with several independently enclosed boxes. By pulling cut tapes the lid of one or more of the interior boxes may be opened for displaying the contents. Also, further peeling of the cut tapes may divide the interior boxes into independently separate smaller boxes having individual lids thereon.

12 Claims, 14 Drawing Figures

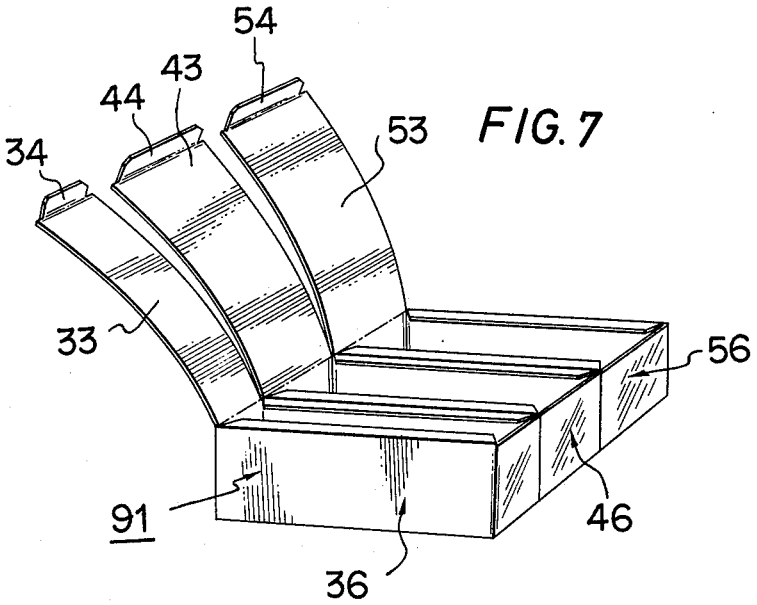
FIG. 7
FIG. 8
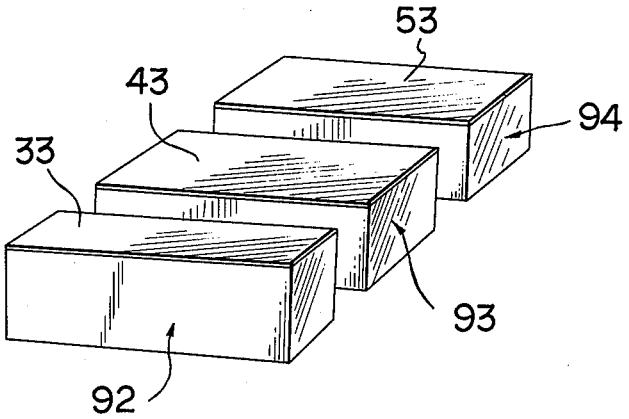

PACKING BOX

The invention relates to improvements in packing boxes formed of cardboards or corrugated cardboards.

More particularly, the invention relates to a packing box wherein the inside surfaces of a bottom plate, lid plate and front and rear plates for a packing box, having a certain capacity as a whole, are sectioned to be partitioned in the width direction by pasting a plurality of adhesive tapes so that the box may be used as a single packing box having partition plates sectioned into a plurality of sections as a whole by exposing some of the tapes out of the packing box, or a plurality of packing boxes of smaller units by peeling off the tapes.

BACKGROUND OF THE INVENTION

Boxes formed of corrugated cardboards or hard cardboards are used as packing boxes for various kinds of articles. It is conventional to unseal such a box by separating the body and lid of the box from each other by peeling off tapes or preset incisions. Once the box is unsealed, no article can be packed unless another adhesive tape or the like is used.

As using adhesive tapes instead of the above incisions for packing boxes, there has been suggested a box which can be unsealed by being divided into upper and lower parts or a plurality of parts by peeling off tapes. However, after it is unsealed, it cannot be used for repacking.

Further, there has been suggested a packing box forming two box bodies by using only a bottom in common so that, by peeling off tapes provided in the bottom, the two box bodies may be separated. Only the bottom is used in common but the lid plate and others are separate. Therefore, it cannot be used as a box sectioned in the interior, but only makes two boxes from one.

The prior art is exemplified by U.S. Pat. Nos. 3,007,623; 3,101,880; 3,327,923; and 3,677,458; and Japanese Patent Publications Nos. 41-13340; 48-7442; 48-39235; 49-12137; and 49-15550. However, none of the prior art suggests a packing box wherein different kinds of articles can be sectioned and contained, the interior is sectioned into two sections, the sections can be separated through incisions or can be cut off by the remaining part of a strip without using any tape or only a part is connected as an entirely separate box from the first and can be separated, and wherein a plurality of inner boxes are enclosed within an outer box so that the enclosing part may be peeled off, one box is sectioned in the interior, each section is divided to be entirely separate and can be perfectly opened and closed, and the box can be easily unsealed and divided.

There are many problems in the unsealing means or dividing means for conventional packing boxes.

SUMMARY OF THE INVENTION

The present invention provides a packing box which includes a base board made of corrugated cardboard on which a plurality of cut tapes are provided parallel at a predetermined spacing on the inside surface of the board to section the base board in its width direction into a number of sections. Also included are two bending lines provided in a direction rectangularly intersecting the tapes to form continued bottom plates, rear plates, and lid plates sectioned by the tapes. Auxiliary plates equal in number to the number of sections are connected wth the base board, are provided at least with a front plate and right and left side plates, are made bendable along bending lines on the boundaries of the front plate and right and left side plates, and are formed of the same material as of that of the base board. When the base board is bent inside along the two bending lines and the front plates of the respective auxiliary plates are erected, and the right and left side plates are bent and are connected with the respective sections of the bottom plate, a plurality of sectioned box-shaped parts are formed on a common bottom plate. The box-shaped parts are opened and closed with a common lid continued with the bottom plate and rear plate. The lid is peeled off and broken in the forward and rearward direction for the respective sections by pulling grippable parts of the tapes in the end parts of the lids, and lids opening and closing independently for the respective sections are formed and the rear plates and bottom plates are peeled off and broken in the forward and rearward direction for the respective box-shaped parts by selectively peeling off the tapes so that the respective box-shaped parts may be divided into independent boxes of smaller units.

An object of the invention is to provide a packing box which is a single box sectioned into a plurality of sections in the interior so that, by peeling off cut tapes, the lid may be opened and the contents may be displayed or taken out and the lid of any section may be opened and, by further peeling off the cut tapes, the box may be divided into a plurality of independent boxes of smaller units each provided with a lid and functioning as an entirely separate box.

According to the invention, at least one bottom plate, lid plate and front and rear plates is formed of one plate in common, and sectioned into a plurality of section in the width direction. Each section is provided with side plates forming both side walls. Selectively one of the front and rear plates and cut tapes are pasted to the inside surface of the sectioned part of each section. A packing box free to open and close and having at least one of the lid, bottom and front and rear plates in common is assembled by bending the side plates and base plate. The interior of the packing box is sectioned into a plurality of independent chambers with the side plates. These chambers can be formed to be different in capacity, e.g., large and small or large, medium and small, by selection of the dimensions of the sections. The packing box is formed as a single box provided with sectioned boxes of the same or different capacities. The cut tape is provided to partition the boundary of each chamber on the lid, front and rear plates and bottom within the packing box, and is partly exposed out of the front end of the lid. By pulling and peeling off this cut tape, the lid is broken from the lid of the other chamber and can be opened and closed independently of the other lid. The chamber below this lid can be opened and the contents can be taken out and displayed, while the other lid is closed. While only a part of the packing box is opened, the articles can be taken out and displayed. The lid of any desired part can be opened by pulling the cut tapes. In case articles are contained in the entire box, for example, one dozen in the first section, two dozen in the second section and three dozen in the third section, when only two dozen are required, the lid of that section will be able to be opened an the articles will be able to be taken out, but the other sections will be able to remain closed and packed.

Not only the lid can be opened, but also the packing box can be divided into boxes of smaller units.

When the tape is pulled further, it will peel off the entire periphery of the box. The box of the peeled part will be separated from the other parts of the packing box, and will be formed as an entirely independent box of a smaller unit. This box will be formed as a perfectly functioning box of a smaller unit enclosed on the lid, bottom, front and rear plates and right and left sides. When the cut tape of the other section is peeled off, a box of a smaller unit will be obtained in the same manner. In case the packing box is sectioned, for example, into three units, the respective units can be set to be of the same or different capacities and can be made a packing box sectioned in the interior as it is. One of the units can be separated as a box of a smaller unit, and the others can be made an independent box having two sections. Also, the packing box can be used as three independent boxes of smaller units.

An object is to provide a packing box wherein, by peeling off any of a plurality of cut tapes, the lid of any part can be opened. By further continuing peeling off the tape, independent boxes of small units can be obtained.

Another object is to provide a packing box which can contain articles as a sectioned box of a large capacity, is provided with an entire lid which can be opened and closed separately for each section to take out and display the articles, can be carried as an entire box of a large capacity instead of smaller boxes, and is convenient to carry and handle.

A further object is to provide a packing box wherein, by the operation of peeling off cut tapes, a packing box of a single section or desired reduced sections of desired capacities can be obtained. After the division, an independent perfect box of a smaller unit provided with a lid is obtained. No repacking is required, and article circulation such as sale and transportation are made easy and speedy. Packing is made simple, even after the unsealing, the box functions as a box of a small unit, is therefore useful and advantageous in saving resources.

Another object is to provide a packing box wherein the whole is sectioned into a plurality of sections, is carried as one packing box and articles can be divided and sold as contained in the box of the smaller unit on the spot as required by consumers, can be sold as articles of a smaller unit as required by consumers, and can be transported to retailers as contained in one packing box of a large capacity to be stored by retailers as required by consumers.

Each section is provided with an auxiliary plate forming three pieces as bent in the end part of a base board which is a base plate. A front or rear plate and right and left auxiliary plates are formed of the three pieces. The base board is bent to form a lid, front or rear plate and bottom. The auxiliary plate is bent to form side walls which are also right and left partition plates. In this case, the front or rear plate and bottom are formed of the base board to form a packing box of a common base board sectioned with the side plates.

The auxiliary plate forms the right and left side plates, front and rear plates and bent bottom plate so that double bottoms may be formed of the bottom part of the base board and the bottom plate. Each section may be reinforced by the inner Articles ARticles of compartively small bottom area and large weight may be contained and held by increasing the strength of the bottom. The cut tape to be peeled off is provided on the boundary of the section formed of each auxiliary plate. Because only the base board is broken with the tape, the packing box can be unsealed and divided into smaller units easily while increasing its strength.

The invention includes a packing box wherin the base board purely forms a bottom of a smaller unit, or a base board forms an outer bottom member and an inner bottom member is separately provided to increase the strength.

BRIEF DESCRIPTION OF THE DRAWINGS

FIGS. 1 through 8 show a first embodiment of a packing box according to the invention.

FIG. 1 is a developed view of the first embodiment.

FIGS. 2 through 4 are developed view of auxiliary plates as connected with respective sections of a base board.

FIG. 5 is a perspective view of an assembly in the making.

FIG. 6 is an explanatory view showing a cut tape as being peeled off an assembled packing box.

FIG. 7 is a perspective view as the base plate is cut off.

FIG. 8 is a perspective view of boxes of smaller units as divided.

FIG. 9 is a developed view wherein only one auxiliary piece is fitted for ease of understanding.

FIG. 10 is a perspective view of a section of a smaller unit formed only of an auxiliary piece.

FIG. 11 is a perspective view showing that auxiliary pieces are fitted to a base board, one of which is developed, but the others are fitted as assembled small units.

FIG. 12 is a perspective view wherein all the auxiliary pieces are assembled to be of smaller units.

FIG. 13 is a perspective view of a packing box.

FIG. 14 is an explanatory view of a cut tape as being peeled off.

DETAILED DESCRIPTION

Figure 1:
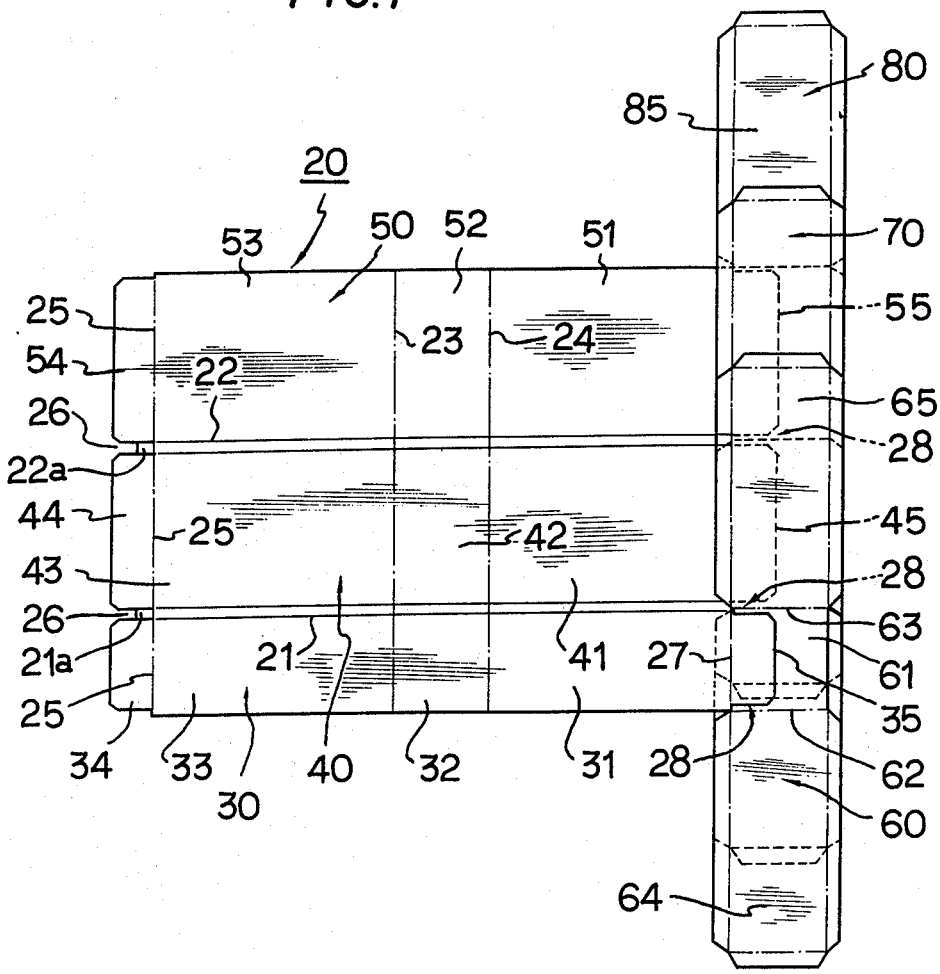

FIGS. 1 through 8 show a first embodiment of the invention. Reference numeral 20 shown in FIG. 1 indicates a base board forming a single base plate made of cardboard or corrugated cardboard. On the inside surface of base board 20, cut tapes 21 and 22 are pasted parallel in the forward and rearward direction (in the horizontal direction in the drawing) at a proper spacing in the width direction (in the vertical direction in the drawing). In this embodiment, two cut tapes are used to section the base board 20 into three sections 30, 40 and 50 in the width direction. Two bending lines 23 and 24 are made parallel in the width direction in the middle part in the forward and rearward direction of base board 20. The parts enclosed by bending lines 23 and 24 comprise rear plates 32, 42 and 52 of respective sections 30, 40 and 50. Outside of bending lines 23 and 24, one side comprises bottom plates 31, 41 and 51, and the other side comprises lid plates 33, 43 and 53. The areas of bottom plates 31, 41 and 51 and the areas of lid plates 33, 43 and 53 are equal to each other. The above parts are integrally continuations of a single base board 20.

The outer end parts of lid plates 33, 43 and 53 formed on the base board are extended and are diagonally cut on both sides to provide inserting flaps 34, 44, and 54, respectively, independently so as not to continue with other adjacent flaps. Flaps 34, 44 and 54 are continued with the lid plates 33, 43 and 53, respectively, and bending lines 25 are provided in the boundary parts. Predetermined clearances 26 are provided in the boundary parts of flaps 34, 44 and 54. Ends 21*a* and 22*a* of tapes 21 and 22 are extended and put in clearances 26.

The outer ends of the bottom plates 31, 41 and 51 are extended and are provided as continued with jointing plates 35, 45 and 55 similar to flaps 34, 44 and 54. Bending lines 27 are provided on the boundaries of jointing plates 35, 45 and 55 with botton plates 31, 41 and 51. Clearances 28, similar to clearances 26, are made in the boundary parts of jointing plates 35, 45 and 55, The other ends of tapes 21 and 22 are provided to the end surfaces of these clearances 28. Auxiliary plates 60, 70 and 80, each comprising a front plate and right and left sides, are connected to jointing plates 35, 45 and 55, respectively, by bending or the like.

Figures 2, 3, 4:
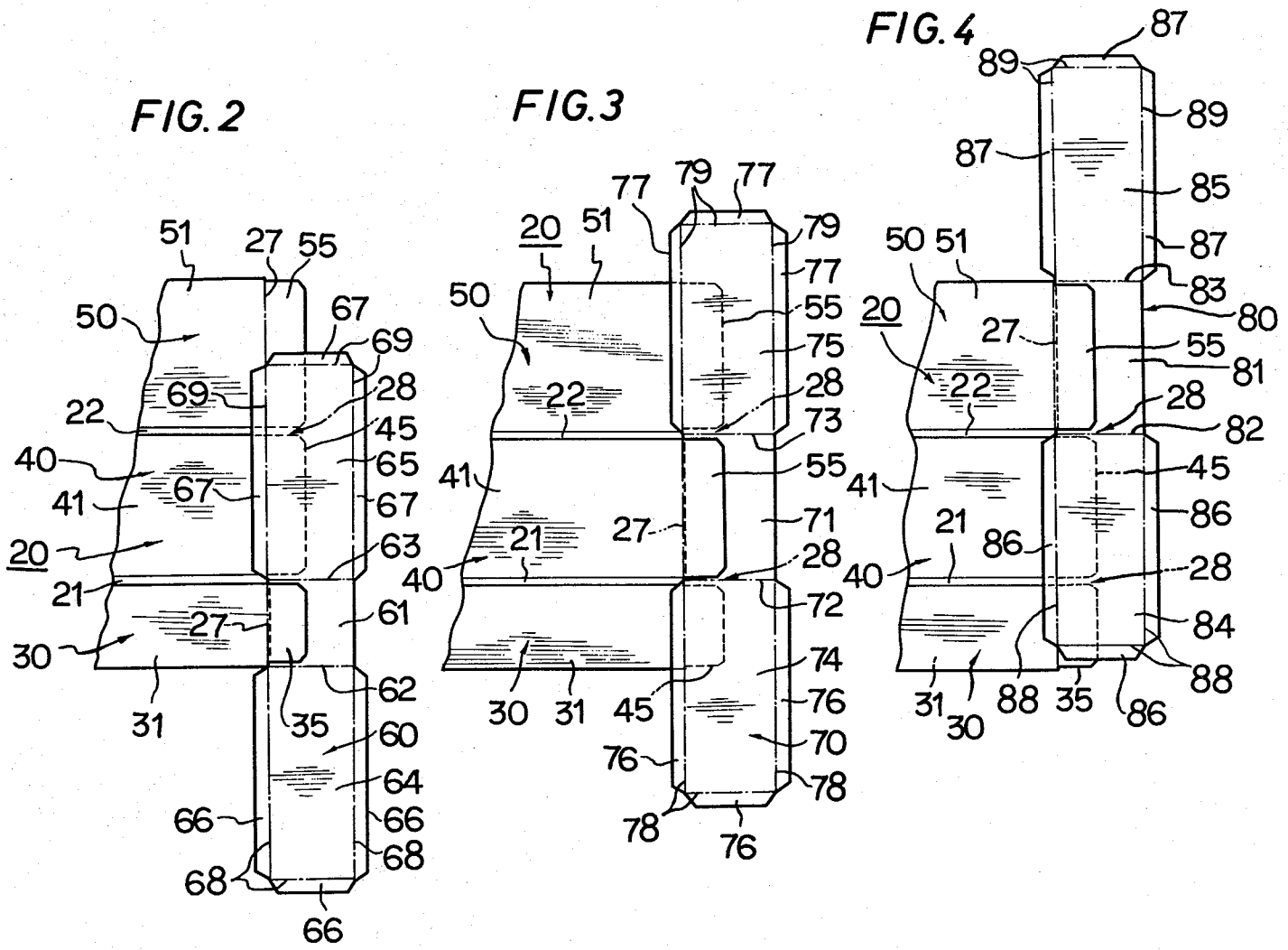

The formation, fitting and relation with the jointing plate of each of the auxiliary plates 60, 70 and 80 are shown in FIGS. 2 through 4.

As shown in FIG. 2, a front plate 61 of auxiliary plate 60 is connected to jointing plate 35, and the height of plate 60 including plate 61 is made the same as that of rear plate 32. The width of plate 61 is equal to the width of bottom plate 31. Sides 64 and 65 are integrally continued with plate 61 through bending lines 62 and 63. The length of each of the sides 64 and 65 is equal to the length of bottom plate 31. Three sides, with the exception of bending lines 62 and 63, of each of the side plate parts 64 and 65 are provided with jointing parts 66 and 67 through bending lines 68 and 69. Auxiliary plate 60 is formed of one corrugated cardboard or the like.

As shown in FIG. 3, a front plate 71 of auxiliary plate 70 is connected by bonding or the like to jointing plate 45. Front plate 71 is provided with right and left side plate parts 75 and 74 continued respectively through right and left bending lines 73 and 72. Sides 74 and 75 are provided with jointing parts 76 and 77, respectively, and bending lines 78 and 79. The width of front plate 71 is equal to the width of bottom plate 41. The length of each of the sides 74 and 75 is equal to the length of plate 41.

As shown in FIG. 4, a front plate 81 of auxiliary plate 80 is connected by bonding or the like to jointing plate 55. Side plates 85 and 84 are provided as continued through bending lines 83 and 82, respectively, on the right and left of front plate 81, and are provided with jointing parts 87 and 86 and bending lines 89 and 88, respectively.

Auxiliary plates 70 and 80 are formed of one material the same as auxiliary plate 60.

As shown in FIGS. 1 through 4, in the developed state, the packing box consists of base board 20 and three auxiliary plates 60, 70 and 80.

Figure 5:
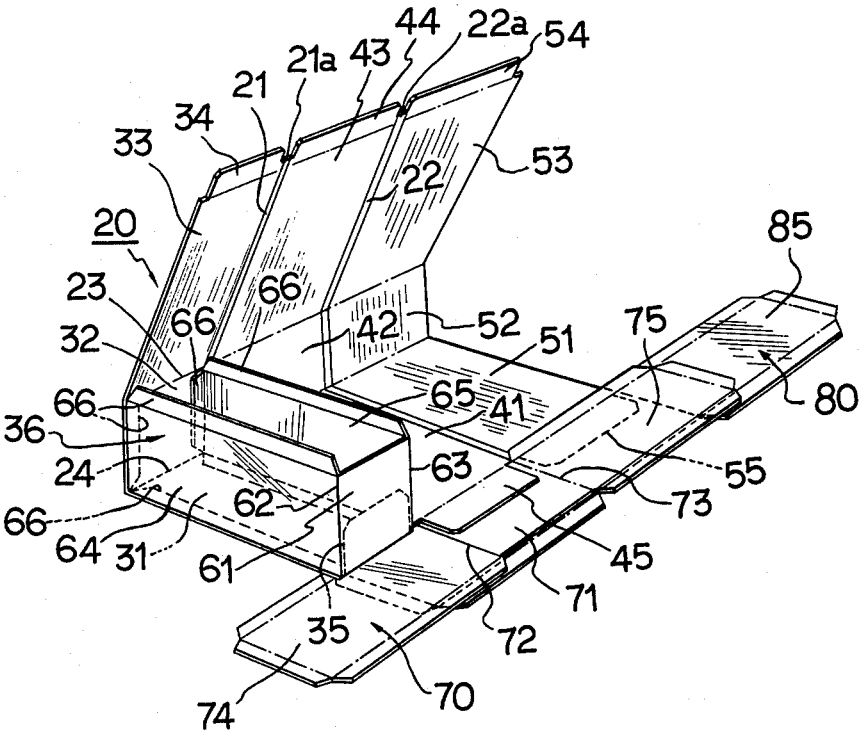

The assembly of the packing box will now be explained. First, the base board 20 is bent inside along lines 23 and 24, the bottom plates 31, 41 and 51 are set below, the lid plates 33, 43 and 53 are set above, and the rear plates 32, 42 and 52 are erected. Then, plate 60 including plate 35 is bent inside along line 27. Plate 60 is erected to make plate 32 face the front 61. Sides 65 and 64 are bent inside along lines 63 and 62. The jointing parts at both ends of each of the sides 64 and 65 are connected by bonding or the like to the inside surfaces near both sides of plate 32. The jointing part on the lower side is connected by bonding or the like to the inside surfaces near both right and left sides of plate 31. The jointing part on the upper surface is made to act as a flap. As shown in FIG 5, there is obtained a first box part 36 having plates 32, 31 and 33 in common with the other parts, and sectioned with sides 64 and 65 and front plate 61. In the other parts adjacent to it, plates 70 and 80 are bent and connected by bonding or the like in turn to form a second box part 46 and a third box part 56 sectioned with respective side plate parts.

Figure 6:
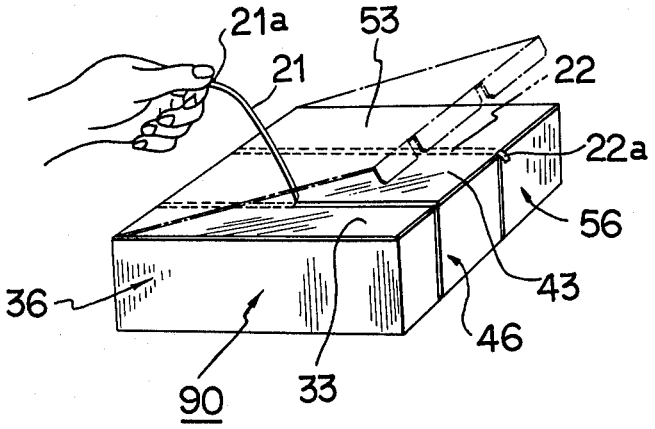

By the above, a packing box 90 as shown in FIG. 6 is obtained. Box 90 is sectioned in its interior as mentioned above. In the illustrated embodiment, there is obtained a box in which three box bodies differing in capacity are integrally continued and contained therewithin.

Box 90 is closed by inserting flaps 34, 44 and 54 of the common lid inside the front plates 61, 71 and 81 of box parts 36, 46 and 56, and is used as a packing box provided with three sectioned chambers when opened. These sections can contain a number of articles corresponding to their capacities. Differing kinds of articles can be contained in the respective sections.

If box 90 is made single and it is necessary to open and close the lid for each of the sectioned box parts 36, 46 and 56, the tips 21*a* and 22*a* of tapes 21 and 22 exposed between flaps 34, 44 and 54 may be gripped by fingers and pulled as shown in FIG. 6 so that the boundary parts of lids 33, 43 and 53 may be linearly peeled and broken off in the forward and rearward direction. As shown in FIG. 7, there is obtained a box 91 wherein lids 33, 43 and 53 are divided and only the bodies of box parts 36, 46 and 56 are integral. Thus, the lids of the respective box parts can be independently opened and closed to individually take out the articles.

If tapes 21 and 22 are pulled further, the boundary parts of box parts 36, 46 and 56 with the rear and bottom plates will be peeled off and broken to finally obtain divided independent boxes 92, 93 and 94 of smaller units (FIG. 8). boxes 92, 93 and 94 become independent sealed single packing boxes of smaller units than of the original box, and each having a lid free to open and close by the above-mentioned structure. In this embodiment, three boxes of smaller units are made. Further, only one box may be divided and the others may be used as boxes having sections. The number of the above-mentioned sections and therefore the number of the finally obtained divided boxes of smaller units are selectively variable. The capacities can also be selectively variable.

FIGS. 9 through 14 show a second embodiment wherein the bottom is made double to be adapted to pack heavy articles.

Figure 9:
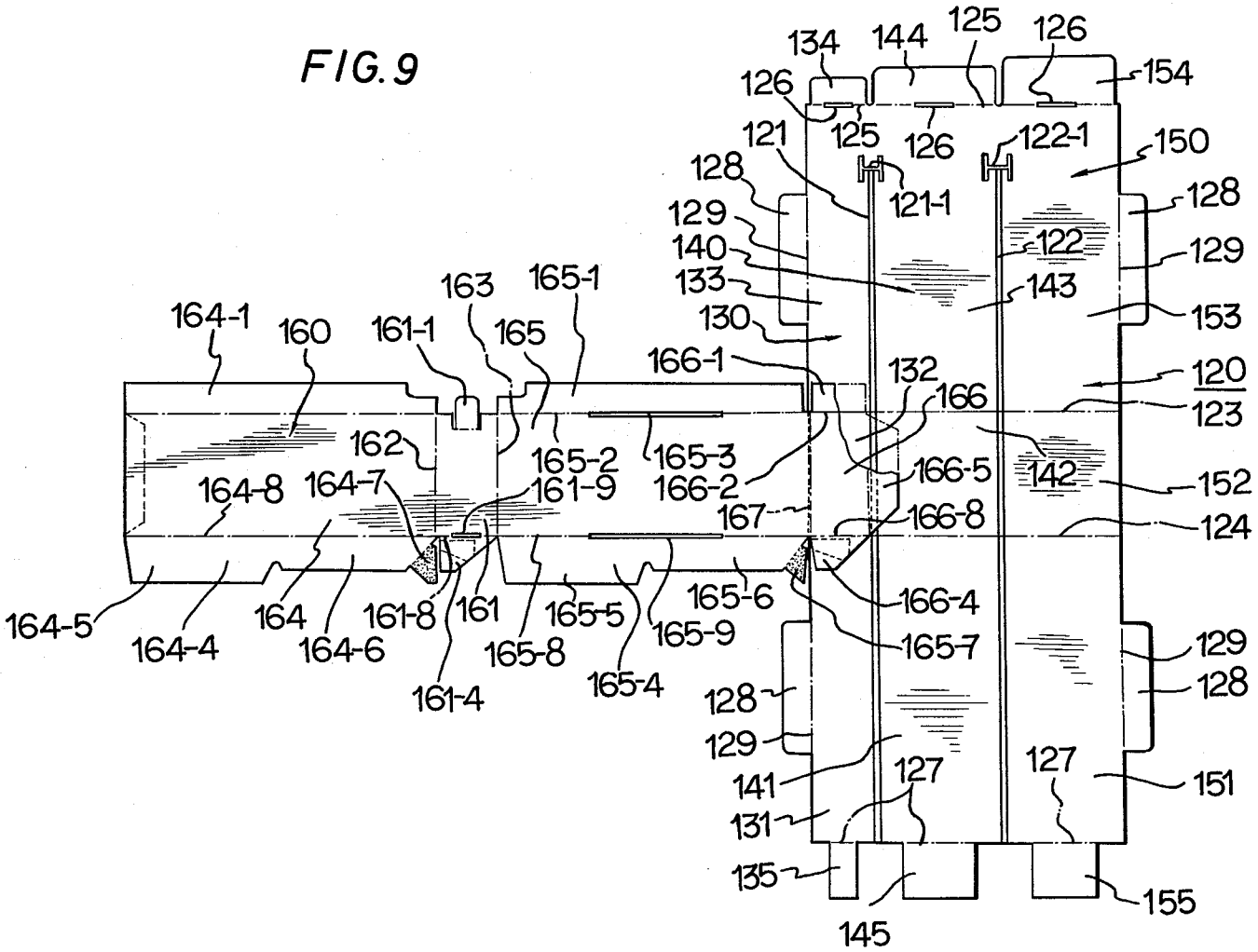
FIGS. 9 through 14 show a second embodiment of the invention.

FIG. 9 shows a developed view. A base board 120 is formed from a single corrugated cardboard. Cut tapes 121 and 122 are pasted parallel at a predetermined spacing onto the inside surface of board 120 to section such inside surface into three sections 130, 140 and 150. Two bending lines 123 and 124 are provided to traverse in the width direction in the middle part of board 120. Bending lines 123 and 124, together with the tapes 121 and 122 form bottom plates 131, 141 and 151, rear plates 132, 142 and 152, and lid plates 133, 143 and 153 as continued to the sections 130, 140 and 150.

Flaps 134, 144 and 154 are provided at the outer ends of lid plates 133, 143 and 153 as integral continuations thereof. The flaps are bendable along bending lines 125. An incision 126 is made in the middle of the boundary bending line between each lid plate and flap. Flaps 135, 145 and 155 are provided at the outer ends of the bottom plates 131, 141 and 151 to be free to bend along bending lines 127. Flaps 128 are provided as integral continuations of the outside edges of bottom plates 131 and 151 and outside lid plates 133 and 153 to be free to bend along bending lines 129 between the flaps and the above-mentioned outside edges.

Auxiliary plates 160, 170 and 180 are connected to the inside surfaces of plates 132, 142 and 152. FIG. 9 shows one auxiliary plate 160 connected to plate 132.

Figure 10:
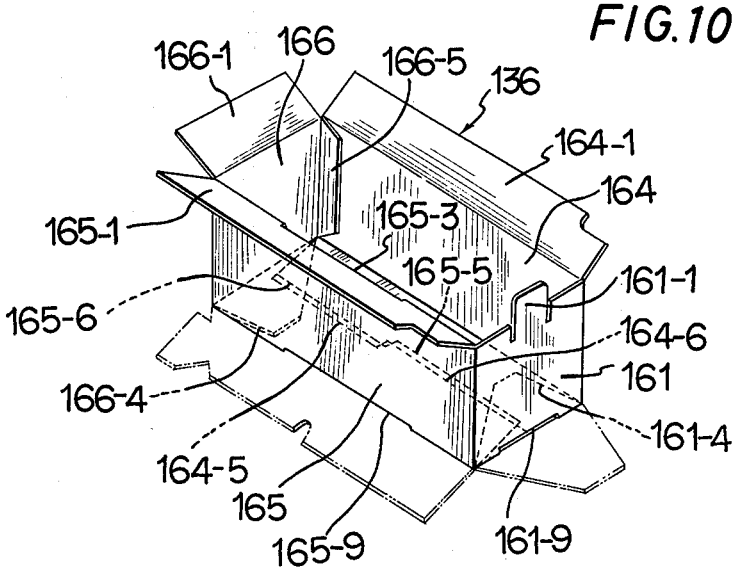

The auxiliary plate 160 is clearly shown in FIG. 9 and FIG. 10. Plate 160 has a rear plate part 166 connected by bonding or the like to rear plate 132, side plate part 165 on one side, front plate part 161 and side plate part 164 on the other side in the direction of lines 123 and 124, and is formed on one corrugated cardboard or the like. Bending lines 163 and 162 are provided on the right and left of part 161. A bending line 167 is provided between side plate 165 and rear plate part 166. Flaps 166-1, 165-1, 161-1 and 164-1 are provided as integrally extended above the rear plate part 166, side plate part 165, front plate part 161 and side plate part 164, and independently of the adjacent flaps and are bent along bending lines 166-2, 165.2, 161-2 and 164-2. An incision 165-3 corresponding to flap 128 of lid 133 is made in the middle of line 165-2 of part 165. Flap 161-1 has a width corresponding to the width of incision 126.

Flaps 166-4, 165-4, 161-4 and 164-4 are provided as integrally extended below the parts 166, 165, 161 and 164 to form a part of the inner bottom. Flaps 165-4 and 164-4 are provided with parts 165-5 and 164-5 which are of ½ the width of front part 161 and parts 165-6 and 164-6 which are of a width larger than that. A jointing part 164-7 is provided as continued in the end portion of part 164-6. A jointing part 165-7 is provided as continued in the end portion of part 165-6. The flaps are bent along bending lines 166-8, 165-8, 161-8 and 164-8. An incision 165-9 corresponding to flap 128 of plate 131 is made in line 165-8. Flap 161-4 is provided with an incision 161-9 corresponding to the flap 135 of plate 131. A jointing part 166-5 is integrally extended outside the rear plate 166.

The other auxiliary plates 170 and 180 are of exactly the same structure as mentioned above with respect to plate 160 (FIG. 11). Incisions like 165-3 and 165-9 are made only in the auxiliary plate positioned in the outermost side of the section 150. The dimensions are fitted to the respective sections, and the auxiliary plates are connected to the rear plates 142 and 152 of the respective sections.

FIG. 10 is a perspective view of a box formed by assembling only the auxiliary plates to facilitate understanding. Plate 160 is bent along lines 162, 163 and 167. Part 166-5 is connected by bonding or the like to the inside surface of the part outside the outside side plate part 164 to be assembled to be square. In this case, side plate part 165 in the developed state will appear outside. Jointing parts 165-7 and 164-7 of the side plate parts 165 and 164 are connected by bonding or the like to the broken line parts shown in FIG. 9 of the front and rear plate parts 161-4 and 166-4. Flaps 165-4 and 164-4 are opposed to each other in these connected parts so as to form an inner bottom. Flaps 165-4 and 164-4 will have the part 164-5 overlapped on the other part 165-6, will have the part 165-5 overlapped on the other part 164-6, and will thus be intermingled and overlapped with each other to form an intermingled inner bottom. When flaps 161-4 and 166-4 connected with jointing parts 164-7 and 165-7 are bent, the flaps 164-4 and 165-4 forming the inner bottom will automatically be bent inside the box, and the box will collapse along the bending line of the diagonal to be flat. When developed, it will return to a box-shaped body as in FIGS. 10 through 12.

The box body 136 is connected to the inside surface of the rear plate 132 of the section 130 of the base board 120 through the rear plate part 166.

Figure 11:
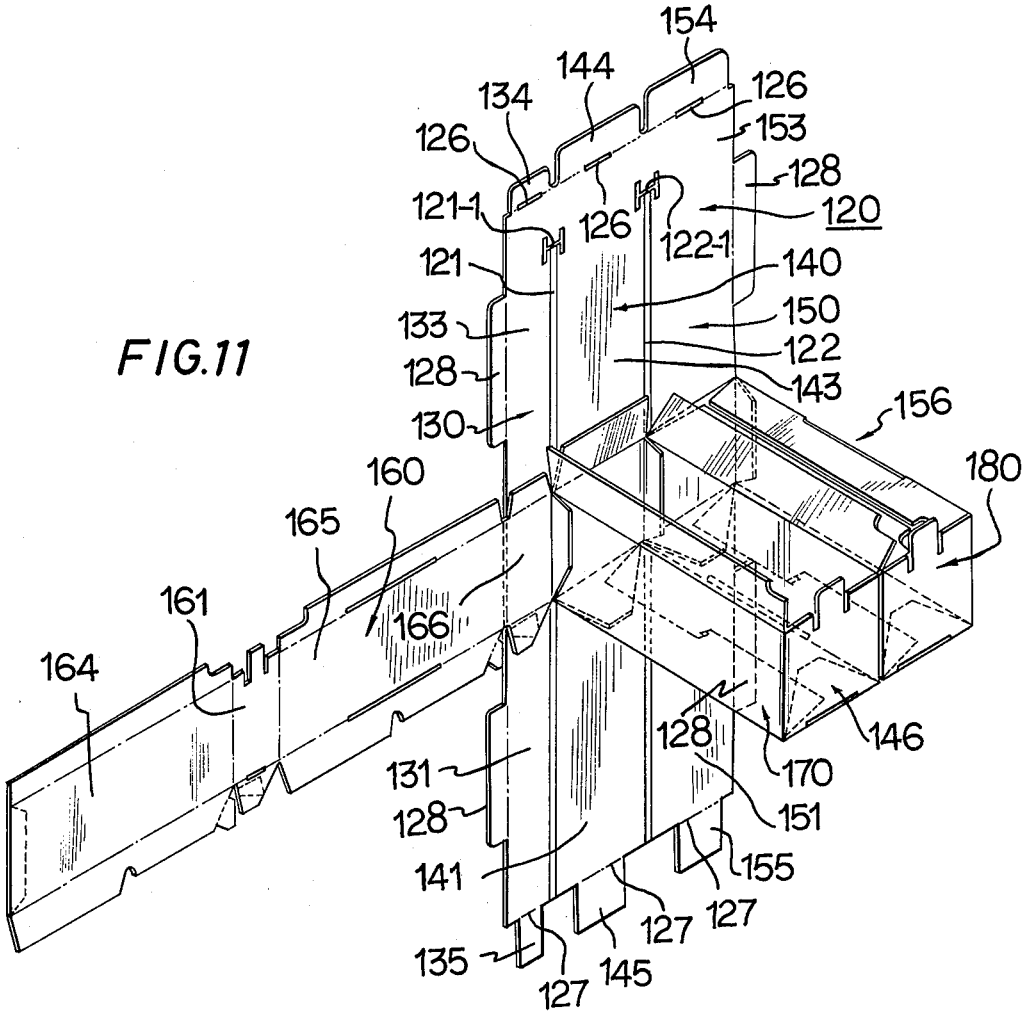
Figure 12:
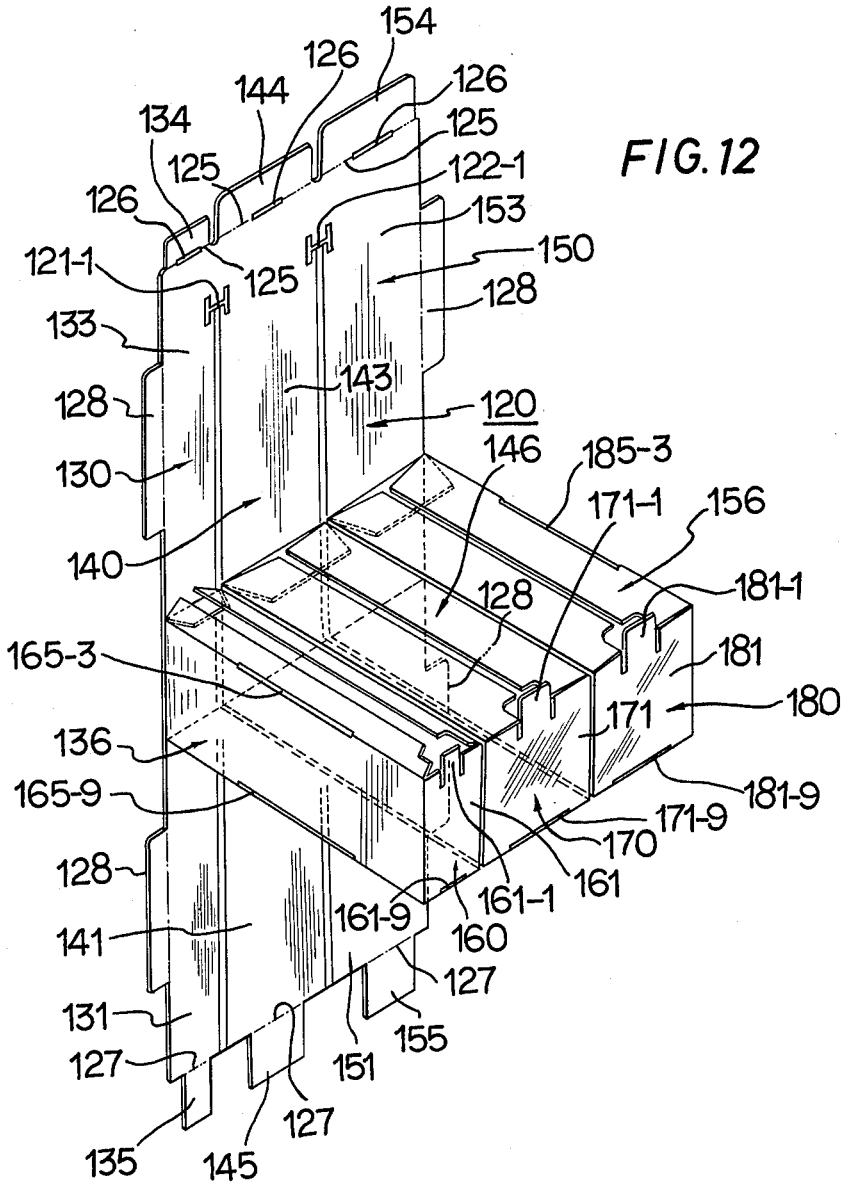

FIG. 11 shows a perspective view of box bodies 146 and 156 already formed integrally by assembling respectively the other two auxiliary plates 170 and 180 in the sections 140 and 150 of the base board, the auxiliary plate 160 being developed. FIG. 12 shows a perspective view of box bodies 136, 146 and 156 formed by assembling all the auxiliary plates 160, 170 and 180.

Figure 13:
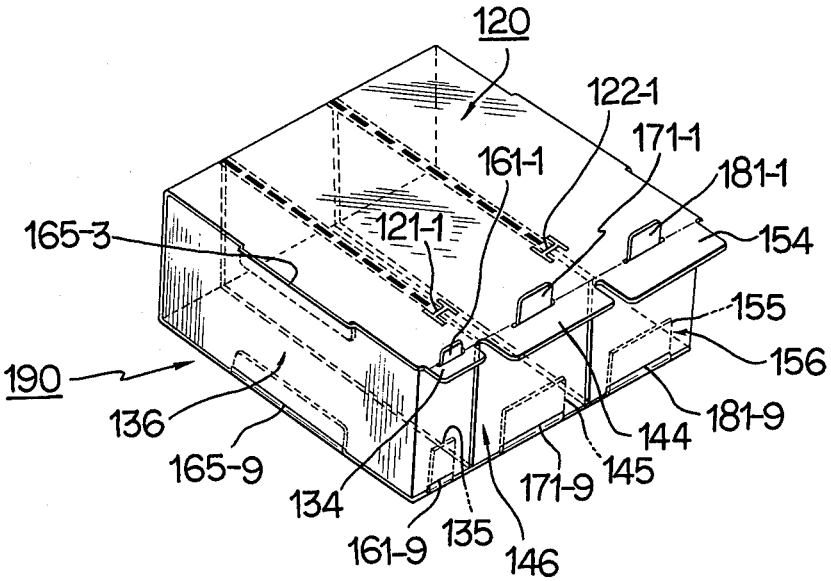
Figure 14:
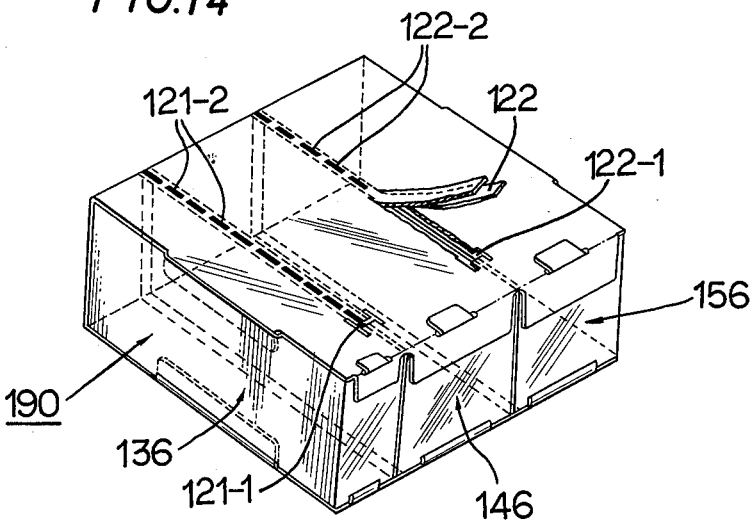

Tapes 121 and 122 are provided each at one end to the end edges of bottom plates 131, 141 and 151, and are stopped each at the other end before the end edges of lid plates 133, 143 and 153. Incisions 121-1 and 122-1 are made in these end parts. The corresponding end parts of tapes 121 and 122 are positioned in these incisions. In the illustrated embodiment, incisions 121-1 and 122-1 are H-shaped so that the tapes may be easy to peel off from outside. Bodies 136, 146 and 156 assembled in such developed state of the base board 120 as in FIG. 12 are folded along the bending line parts of the diagonals to be flat as already described. Then, in the FIG. 12 configuration, the base board 120 is bent inside along the bending lines 123 and 124, the lid plates 133, 143 and 153 are applied onto the box bodies 136, 146 and 156, and the bottom plates 131, 141 and 151 are applied below bodies 136, 146 and 156. In such case, the flaps 128 are erected and are inserted into incisions 165-3, 165-9 and 185-3 of the outside bodies 136 and 156. FIG. 13 shows that the flaps 135, 145 and 155 are inserted into incisions 161-9, 171-9 and 181-9 in the front plate parts 161, 171 and 181. The corresponding flaps 161-1, 171-1 and 181-1 of the box bodies are inserted into incisions 126 of lidp lates 133, 143 and 153. Flaps 161-1, 171-1, 181-1, 134, 144 and 154 are bent, are overlapped on the lid plates 133, 143 and 153 and front plate parts 161, 171 and 181, and are connected by bonding or the like so that a perfectly packed box 190 is obtained.

Packing box 190 is provided with the sectioned box bodies 136, 146 and 156, is of a double structure provided with the inner bottom and inner lid by the upper and lower flaps, and is adapted to pack articles of small volumes and large weights as cans. All the lids are opened by peeling off the flaps 134, 144, 154, 161-1, 171-1 and 181-1. When the box bodies are to be divided into smaller units, when the incisions 121-1 and 121-1 are peeld off by inserting a finger and the peeled parts of the incisions are pulled, the boundary parts of bodies 136 with 146 and 146 with 156 of the base board will be broken. In the illustrated embodiment, breaking line marks 121-2 and 122-2 are provided to indicate the breaking directions. When tapes 121 and 122 are peeled off along the breaking line marks 121-2 and 122-2 and the boundary parts are broken, the bottom plates will be separated and broken to the end parts. The parts in front of incisions 121-2 and 122-1 will remain unbroken but, when the box body 136 or 156 is moved to be separated from the intermediate box body 146, these remaining parts will be easily broken to obtain entirely separate boxes of smaller units.

I claim:

1. A packing box, comprising:

a base board (20) made of corrugated cardboard on which a plurality of cut tapes (21, 22) are provided parallel at a predetermined spacing on the inside surface of said board to section said base board in its width direction into a number of sections;

two bending lines (23, 24) are provided in a direction rectangularly intersecting said tapes (21, 22) to form continued bottom plates (31, 41, 51), rear plates (32, 42, 52), and lid plates (33, 43, 53) sectioned by said tapes (21, 22);

auxiliary plates (60, 70, 80) equal in number to said number of sections are connected with said base board, are provided at least with a front plate (61, 71, 81) and right (65, 75, 85) and left side plates (64, 74, 84), are made bendable along bending lines (62, 63, 72, 73, 82, 83) on the boundaries of said front plate and right and left side plates, and are formed of the same material as of that of said base board (20);

whereby when said base board (20) is bent inside along said two bending lines (23, 24) and said front plates (61, 71, 81) of said respective auxiliary plates (60, 70, 80) are erected, and said right (65, 75, 85) and left side plates (64, 74, 84) are bent and are connected with the respective sections of the bottom plate, a plurality of sectioned box-shaped parts (36, 46, 56) are formed on a common bottom plate;

said box-shaped parts (36, 46, 56) are opened and closed with a common lid continued with the bottom plate and rear plate;

said lid is peeled off and broken in the forward and rearward direction for the respective sections by pulling grippable parts (21*a*, 22*a*) of said tapes (21, 22) in the end parts of said lids; and lids (33, 43, 53) opening and closing independently for the respective sections are formed and said rear plates and bottom plates are peeled off and broken in the forward and rearward direction for said respective box-shaped parts (36, 46, 56) by selectively peeling off said tapes (21, 22) so that said respective box-shaped parts (36, 46, 56) may be divided into independent boxes (92, 93, 94) of smaller units.

2. A packing box, comprising:

a base board made of corrugated cardboard or cardboard on which a plurality of cut tapes are provided parallel at a predetermined spacing on the inside surface of said board to section said base board in its width direction into a number of sections;

two bending lines are provided in a direction rectangularly intersecting said tapes to form continued bottom plates, rear plates, and lid plates sectioned by said tapes;

auxiliary plates equal in number to said number of sections on which front plates are connected with jointing plates provided as extended on said bottom plates, and said plates made integral and bendable along bending lines with said front plates;

whereby when said base board is bent inside along said two bending lines, and said front plates of said auxiliary plates are erected, and said side plates are secured on said bottom plates, a common bottom plate, common rear plate and common lid plate are provided and said front plate and said plates form a plurality of box-shaped bodies independently of each other; and said box-shaped bodies are peeled off and broken by pulling said tapes by their exposed parts at the front end of said lid plates and the lid is selectively divided for said bodies or said lid plates, rear plates and bottom plates sections are peeled off and broken by pulling said tapes so that boxes of smaller units may be obtained.

3. A packing box according to claim 2, wherein:

flaps which are to close the lid and to be inserted into and pulled out of the front plates of said boxes of smaller units are provided at the front ends of said lid plates.

4. A packing box according to claim 2, wherein:

bendable jointing parts are provided on three sides of each said side plate;

necessary ones of said jointing parts are connected with the bottom plates and rear plates of the sections to form a plurality of sectioned box-shaped bodies; and the jointing parts opposed to said lid plates are made flaps.

5. A packing box according to claim 2, wherein:

said tapes are extended each at one end to the end edge of said bottom plate and each at the other end to the part outside the end edge of said lid plate.

6. A packing box according to claim 3, wherein:

said flaps are made smaller in the width than the respective sections of the lid plate;

a clearance is made between the flaps; and said tape is extended at one end into said clearance.

7. A packing box, comprising:

a base board made of corrugated cardboard or cardboard on which a plurality of cut tapes are parallel provided at a predetermined spacing on the inside surface of said board to section said board in its width direction into a number of sections;

two bending lines are provided in a direction rectangularly intersecting said tapes to form continued bottom plates, rear plates, and lid plates sectioned by said tapes;

auxiliary plates equal in number to said number of sections on which rear plate parts are connected with the inside surfaces of said rear plates of said base board, and right and left side plates continued to one side of said rear plate parts to be bendable along bending lines, and front plates provided between them are provided in the respective sections;

said rear plate parts of said auxiliary plates are connected respectively with the end parts of the side plates not continued with them;

said front plates and right and left side plates are bent along the bending lines to form square frames in the respective sections;

said base board is bent along the bending lines to close said frames above and below with the bottoms and lids; and the respective sections are divisible into box bodies of small units by said tapes.

8. A packing box according to claim 7, wherein:

flaps are provided as continued above and below the front plates and rear plate parts and right and left side plates of said auxiliary plates; and box bodies of smaller units having inner lids and inner bottoms are provided by bending said flaps inside.

9. A packing box according to claim 8, wherein:

the flaps of the front plates and rear plates parts are connected with the ends of the flaps below the respective side plates.

10. A packing box according to claim 8, wherein:

incisions are made between at least the lower ends of the respective front plates and the inner bottoms of said box bodies of smaller units;

flaps are provided as extended on the bottom plates of the respective sections and are inserted into the respective incisions; and flaps are provided at the upper ends of the respective front plates and are inserted into respective incisions made in flaps extended out of the lid plates of the respective sections to fix the bottom and lid.

11. A packing box according to claim 8, wherein:

incisions are made above and below the outside parts of the outside box bodies; and flaps provided at both outside ends of said base board are inserted into said incisions to fix said box bodies, bottoms and lids.

12. A packing box according to claim 7, wherein:

said tapes are provided to the front end of the bottom plate and to a part before the front end of the lid plate; and incisions are made in the end parts of the tapes of the lid plate.

* * * * *